US006650759B1

(12) United States Patent
Nakamura et al.

(10) Patent No.: US 6,650,759 B1
(45) Date of Patent: Nov. 18, 2003

(54) SPEAKER

(75) Inventors: Takeshi Nakamura, Uji (JP); Takayuki Kaneko, Kyoto (JP); Yutaka Murai, Nagaokakyo (JP); Takao Mouri, Osaka-fu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 233 days.

(21) Appl. No.: 09/597,809

(22) Filed: Jun. 21, 2000

(30) Foreign Application Priority Data

Jun. 29, 1999 (JP) ..... 11-182951

(51) Int. Cl.[7] ..... H04R 25/00

(52) U.S. Cl. ..... 381/190; 381/398; 381/430; 181/171

(58) Field of Search ..... 381/190, 398, 381/173, 430, FOR 153; 181/171, 172

(56) References Cited

U.S. PATENT DOCUMENTS

| | | | | |
|---|---|---|---|---|
| 4,377,617 A | | 3/1983 | Ikei et al. | |
| 5,802,196 A | * | 9/1998 | Nakamura | 381/190 |
| 6,141,429 A | * | 10/2000 | Heinouchi | 381/398 |
| 6,154,556 A | * | 11/2000 | Takahashi et al. | 381/430 |

FOREIGN PATENT DOCUMENTS

GB 2 322 589 A 9/1998

* cited by examiner

*Primary Examiner*—Curtis Kuntz
*Assistant Examiner*—Suhan Ni
(74) *Attorney, Agent, or Firm*—Keating & Bennett, LLP

(57) ABSTRACT

A speaker includes a disk-shaped base. A substantially hemispherical surface vibrator is fitted into a substantially circular groove formed in the base to be bonded therein. Terminals are attached to electrodes located on both surfaces of the vibrator. The edge portion of the vibrator is bonded with a first adhesive, and further, its circumference is bonded with a second adhesive. The first adhesive has a sufficient bonding strength between the vibrator and the base. The second adhesive has a lower elastic modulus than the first adhesive.

20 Claims, 5 Drawing Sheets

22

10

SPEAKER

BACKGROUND OF THE INVENTION

1. Field of the Invention

The present invention relates to a speaker, and more particularly to a speaker including a substantially hemispherical surface vibrator.

2. Description of the Related Art

The inventor of the present invention has invented a speaker including a substantially hemispherical surface vibrator, which is described in Japanese Patent Application No. 7-347884 (Japanese Unexamined Patent Publication No. 9-168194). In this speaker 1, as shown in FIG. 7, electrodes 3a and 3b are provided on both surfaces of a substantially hemispherical surface vibrating body 2 made of a piezoelectric material. By inputting a signal between the electrodes 3a and 3b, the vibrating body 2 is vibrated so that an acoustic wave is radiated. The edge portion of the vibrator 2 is attached to a base 4 using an adhesive.

A horn portion 5 is provided in the base 4 having a hole (sound path) enlarging gradually from the inner surface side of the vibrating body 2 toward the outside. With the horn portion 5, an acoustic wave radiated from the inner surface side of the vibrating body 2, caused by the vibration of the vibrator 2, passing through the horn portion 5, is directed to the outside. An acoustic wave radiated from the outer surface side of the vibrating body 2 and an acoustic wave radiated from the inner surface side have a phase difference of 180°. However, the sound waves are manipulated by the horn portion 5 so as to have substantially the same phase in the direction parallel to the installation plane of the speaker 1.

In the above-described speaker, with an input signal, the entire substantially hemispherical surface vibrator expands or shrinks, that is, "breathing-vibrated", so that an acoustic wave is radiated. However, if the bonding strength between the vibrator and the base is weak, additional vibration other than the "breathing-vibration" is generated in the edge portion. When the breathing-vibration and the vibration in the edge portion are present, the sound pressure characteristic diminishes as a whole, and a sufficient sound pressure characteristic in the whole range of a required frequency band cannot be obtained. Further, thermal shock testing is carried out to confirm the reliability of a speaker. If the bonding strength of the adhesive is weak, the vibrator may peel away from the base, caused by the difference between the coefficients of thermal expansion of the vibrator and the base.

Moreover, if the bonding strength of the adhesive is too high, the vibration, generated in the edge portion of the vibrator, is suppressed. However, where the bonding strength is excessively high, the breathing-vibration of the vibrator is severely divided, and the base vibrates with the vibration leakage from the vibrator. For this reason, a distinct peak (a high portion where a sound level is prominent) and dip in sound pressure occur in the sound pressure characteristics. Thus, good sound pressure characteristics cannot be obtained. Further, in reliability testing, the vibrator may be broken, caused by the difference between the coefficients of thermal expansion of the vibrator and the base.

SUMMARY OF THE INVENTION

In order to overcome the problems described above, preferred embodiments of the present invention provide a speaker having high reliability, in which excellent sound pressure characteristics are obtained.

According to one preferred embodiment of the present invention, a speaker having a substantially hemispherical surface vibrator, a base bonded to the edge portion of the vibrator, a first adhesive disposed between the edge portion of the vibrator and the base to bond the vibrator to the base, and a second adhesive disposed at the circumference of the edge portion of the vibrator bonded by the first adhesive.

In this speaker, the vibrator is preferably a substantially hemispherical surface vibrating body including a piezoelectric material, and electrodes provided on the inner surface and the outer surface of the vibrating body.

The first adhesive is used to obtain an appropriate bonding strength between the vibrator and the base. The second adhesive is used to obtain a bonding strength between the vibrator and the base and to damp the vibration of the vibrator. The adhesives are selected such that the second adhesive has a lower elastic modulus than the first adhesive.

In the speaker according to one preferred embodiment of the present invention, a desired bonding strength is obtained, and moreover, vibration leakage from the vibrator is absorbed by the two types of adhesives.

The first adhesive is used to obtain an appropriate bonding strength between the vibrator and the base. Further, the second adhesive is used to obtain a bonding strength between the vibrator and the base, and moreover, functions as a damping material to prevent the vibration of the vibrator from leaking out.

To achieve the above-described effects, the second adhesive has a lower elastic modulus than the first adhesive.

Other features, characteristics, elements and advantages or preferred embodiments of the present invention will be apparent from the detailed description of preferred embodiments of the present invention with reference to the attached drawings.

DETAILED DESCRIPTION OF PREFERRED EMBODIMENTS

Figure 1:
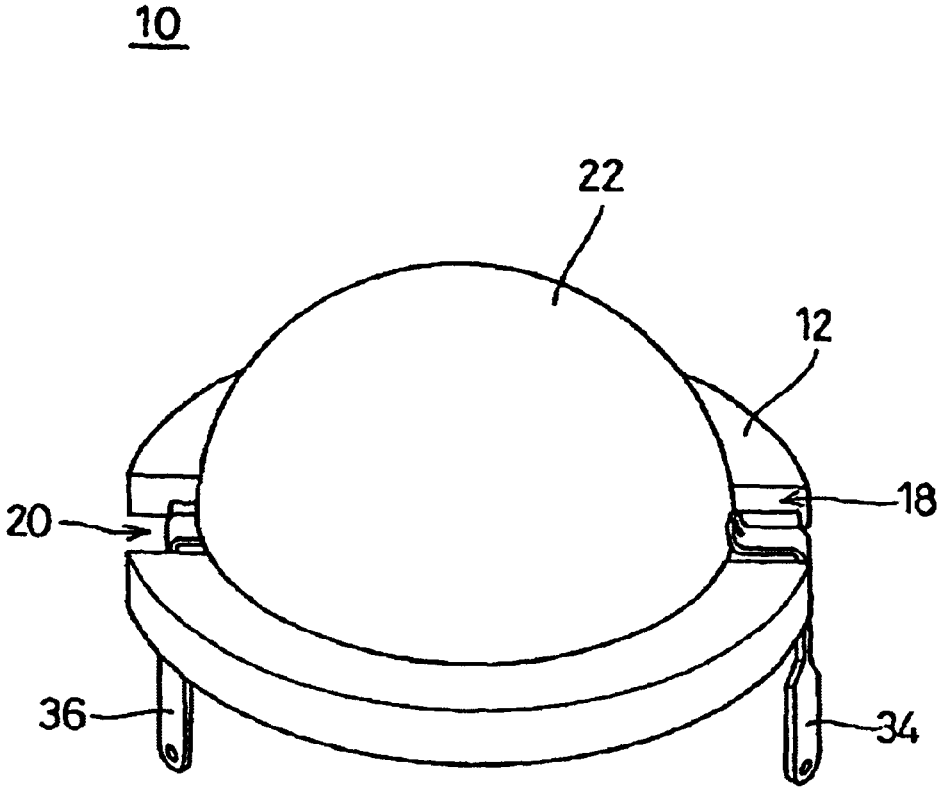
FIG. 1 is a perspective view showing a speaker according to a preferred embodiment of the present invention.
Figure 2:
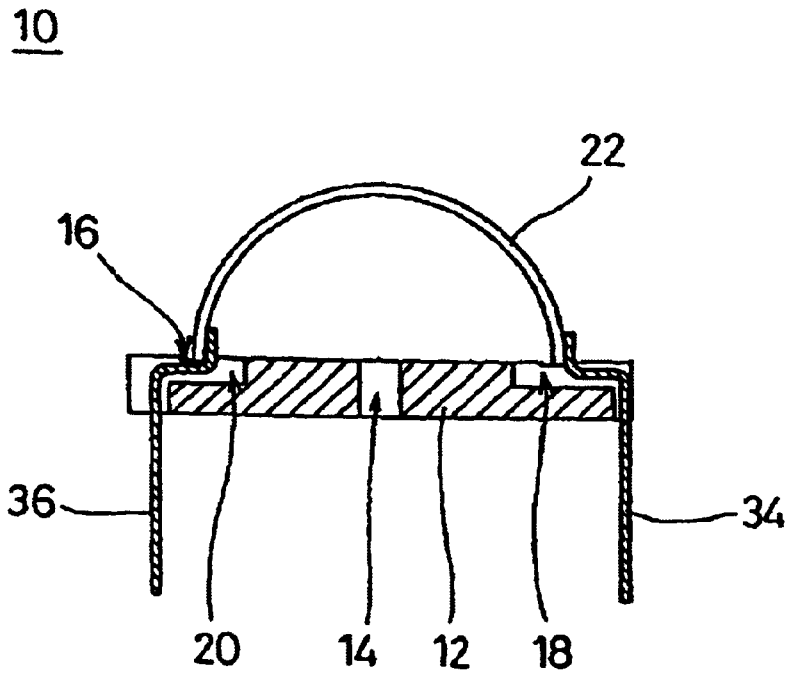
FIG. 2 is an illustrative cross-section of the speaker shown in FIG. 1.

Preferred embodiments of the present invention are described with reference to the attached drawings. Identical elements included in the various preferred embodiments have corresponding reference numerals and repetitious description has been avoided.

FIG. 1 shows a speaker 10 according to a preferred embodiment of the present invention that includes a flat-plate base 12. The base 12 preferably has a disk-shape made of aluminum, or other suitable materials. A small hole 14 is provided in approximately the center of the base 12. Further, a substantially circular groove 16 is provided along the outer circumference of the base 12 on one surface of the base 12. Terminal grooves 18 and 19 are provided in opposite end portions of the base 12, respectively. Each of the terminal grooves 18 and 20 include a depression or recess extending from the one surface of the base 12 toward the edge portion thereof. The terminal grooves 18 and 20 are provided so that terminals described later are led out toward the other surface side of the base 12.

Figure 3:
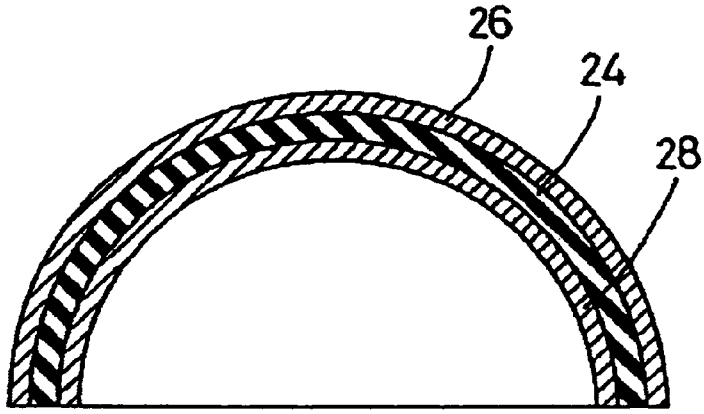
FIG. 3 is a cross-section of the vibrator used in the speaker shown in FIG. 1.

A substantially hemispherical vibrator 22 is bonded to the one surface of the base 12. The vibrator 22, as shown in FIG. 3, includes a substantially hemispherical surface vibrating body 24 made of a piezoelectric ceramic, or other suitable material. The vibrating body 24 is polarized in the thickness direction. A driving mechanism for vibrating the vibrating body 24 is provided by electrodes 26 and 28 that are provided on both surfaces of the vibrating body 24. The electrodes 26 and 28 are formed by plating, vapor depositing, sputtering, or by other suitable method, a conductive material such as gold, silver, nickel, or other suitable conductive material on both surfaces of the vibrating body 24.

Figure 4:
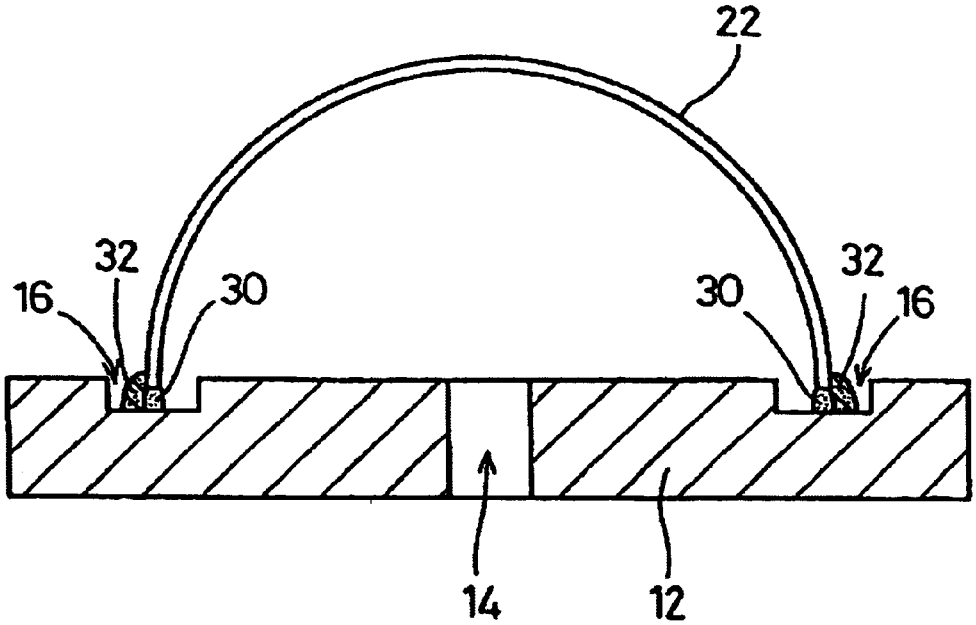
FIG. 4 is a cross-section showing the state that the vibrator and a terminal in the speaker shown in FIG. 1 are bonded to each other.

The vibrator 22 is fitted into the substantially circular groove 16 provided on the base 12. The edge portion of the vibrator 22 is bonded in the groove 16 of the base 12 using a first adhesive 30, as shown in FIG. 4. Further, the circumference of the edge portion of the vibrator 22 is further bonded using a second adhesive 32. The second adhesive has a lower elastic modulus than the first adhesive. The first adhesive is preferably an epoxy type elastic adhesive or other suitable elastic adhesive, and the second adhesive is preferably a urethane-type resin or other suitable adhesive. The small hole 14 provided on the base 12 functions as a degassing hole allowing air which expands due to the heat produced by the bonding of the vibrator 22 to the base 12 to escape. Without such a hole, the expanded air would cause a gap to form between the vibrator 22 and the base 12, thus making the bond between the vibrator 22 and the base 12 unstable. Moreover, terminals 34 and 36 are attached to the electrodes 26 and 28 provided on both surfaces of the vibrating body 24.

The terminal 34 is connected to the electrode 26 provided on the outer surface of the vibrating body 24, and the terminal 36 is connected to the electrode 28 provided on the inner surface of the vibrating body 24. The terminals 34 and 36, passing through the terminal grooves 18 and 20 provided on the base 12, are led out substantially perpendicularly to the surface of the base 12, respectively. To avoid the short-circuiting between the terminals 30, 32 and the base 12, the terminal grooves 18, 20 are configured such that spaces are maintained between the insides of the terminal grooves 18, 20 and the terminals 30, 32. When the base 12 is made of aluminum, the terminals 30 and 32 may contact the base provided that an insulation film by alumite-treating is provided on the surface of the aluminum, or a resin film with insulation properties is provided. When the base is made of an insulation material such as a resin, or other suitable insulation material, with insulation properties, the spaces are not required between the terminals 34, 36 and the base 12.

Referring to the speaker 10, the vibrating body 24 expands or shrinks as a whole, that is, breathing-vibrated by inputting a signal to the terminals 34 and 36, so that an acoustic wave is radiated from the curved outer surface of the vibrator 22. However, the acoustic wave radiated from the inner surface of the vibrator 22 is not radiated to the outside because the base 12 blocks the acoustic wave radiated from the inner surface of the vibrator. It should be noted that the small hole 14 in the approximate center of the base 12 is provided to enable the air present inside to escape, and has no relation to the radiation of the acoustic wave.

In this speaker 10, the first adhesive 30 provides sufficient bonding strength to bond the vibrator 22 to the base 12. In the substantially hemispherical surface vibrator, in addition to the essential breathing-vibration, vibration is generated in the edge portion of the vibrator. Since the sufficient bonding strength is between the vibrator 22 and the base 12, the vibration in the edge portion of the vibrator 22 and the breathing-vibration are adequately divided. Accordingly, a desired sound pressure characteristic is obtained by dividing the breathing-vibration of the vibrator 22 from the vibration in the edge portion. In addition, even if a thermal shock is applied to the speaker 10, the vibrator 22 is not separated from the base 12.

The first adhesive 30 has a sufficient bonding strength to effectively bond the vibrator 22 to the base 12. However, the adhesive does not have an extremely high bonding strength because if the adhesive has an extremely high bonding strength, the vibrator 22 may break, caused by the difference between the coefficients of thermal expansion of the vibrator 22 and the base 12. Accordingly, the first adhesive 30 preferably has sufficient bonding strength such that the vibrator 22 and the base 12 do not peel away from each other, and the vibration in the edge portion of the vibrator 22 and the breathing-vibration are adequately divided from each other.

Figure 5:
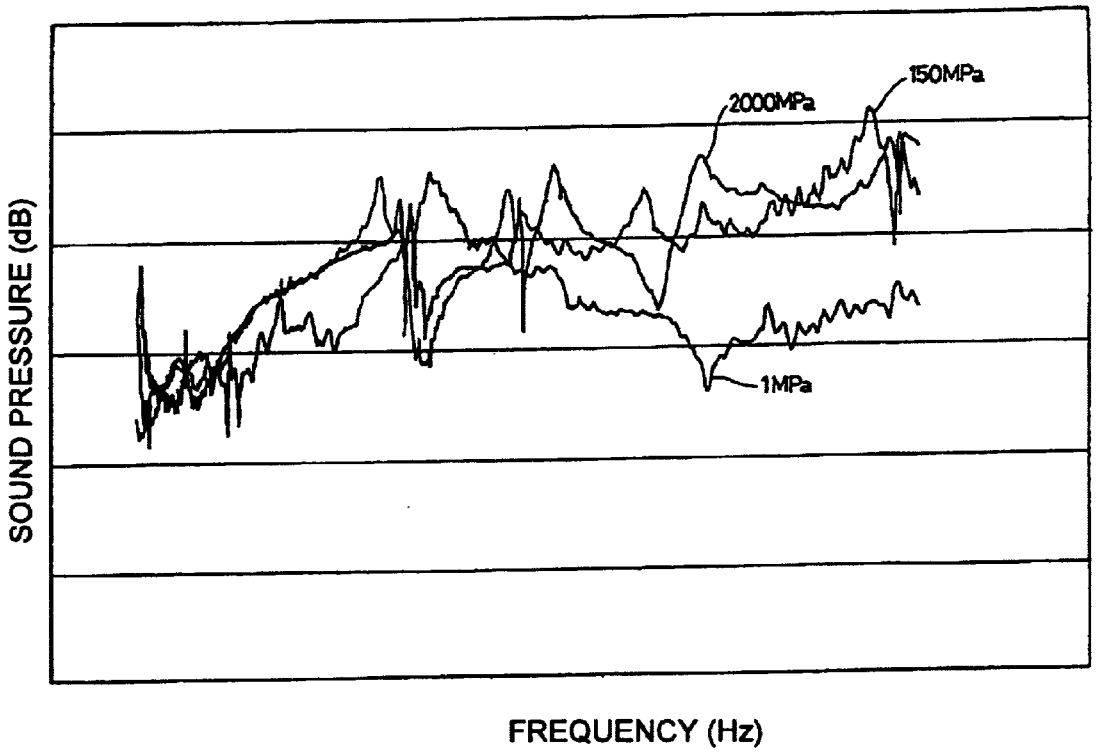
FIG. 5 is a characteristic graph showing the sound pressure characteristics obtained when the vibrator and the base are bonded to each other using an adhesives having elastic modulus of 1 MPa, 150 MPa, and 2000 MPa.

Table 1 shows the relationship between the sound pressure characteristics and the reliability obtained when the vibrator 22 and the base 12 are bonded using one adhesive. This table shows the results obtained when adhesives with three elastic modulus of 1 MPa, 150 MPa, and 2000 MPa were used. FIG. 5 shows the sound pressure characteristics obtained when these adhesives were used. The reliability is measured based upon whether a speaker is broken or not when a thermal shock is applied.

TABLE 1

| ELASTIC MODULUS OF USED ADHESIVE | SOUND PRESSURE CHARACTERISTIC | RELIABILITY |
|---|---|---|
| 1 Mpa | POOR | GOOD |
| 150 Mpa | GOOD | GOOD |
| 2000 Mpa | POOR | POOR |

As seen in FIG. 5, when the adhesive having an elastic modulus of 1 MPa was used, the sound pressure level is reduced overall, and thus the sound pressure characteristic is poor. The poor sound pressure characteristic is due to the bonding strength of the adhesive being insufficient such that the vibration in the edge portion of the vibrator 22 is not suppressed, and the sound pressure characteristic is generated by the breathing-vibration of the vibrator 22 and the vibration in the edge portion only. Further, when the adhesive having an elastic modulus of 2000 MPa was used, many peaks and dips existed in the sound pressure characteristic, and thus the sound pressure characteristic was poor. Since the bonding strength of the adhesive is extremely high, the vibrator 22 and the base 12 are very rigidly bonded, and the overall vibration of the vibrator 22 is severely divided, and thus vibration leakage from the vibrator 22 is generated. Further, since the vibrator 22 and the base 12 are rigidly bonded to each other, the vibrator 22 has a tendency to break. This breakage is caused by the difference between the coefficients of thermal expansion of the vibrator 22 and the base 12, therefore, the reliability is poor.

On the other hand, when the adhesive having an elastic modulus of 150 MPa is used, the sound pressure characteristic and the reliability are very good.

Further, in this speaker 10, the circumference of the edge portion of the vibrator 22 is bonded with a second adhesive 32 having a lower elastic modulus than the first adhesive 30. Therefore, the vibration in the edge portion of the vibrator 22 is damped, so that the vibration leakage is prevented, and moreover, the vibration of the base 12 accompanied with the vibration of the vibrator 22 is suppressed. Therefore, the generation of a peak or dip, which is caused by the vibration leakage, is suppressed in the sound pressure characteristic of the speaker 10.

Figure 6:
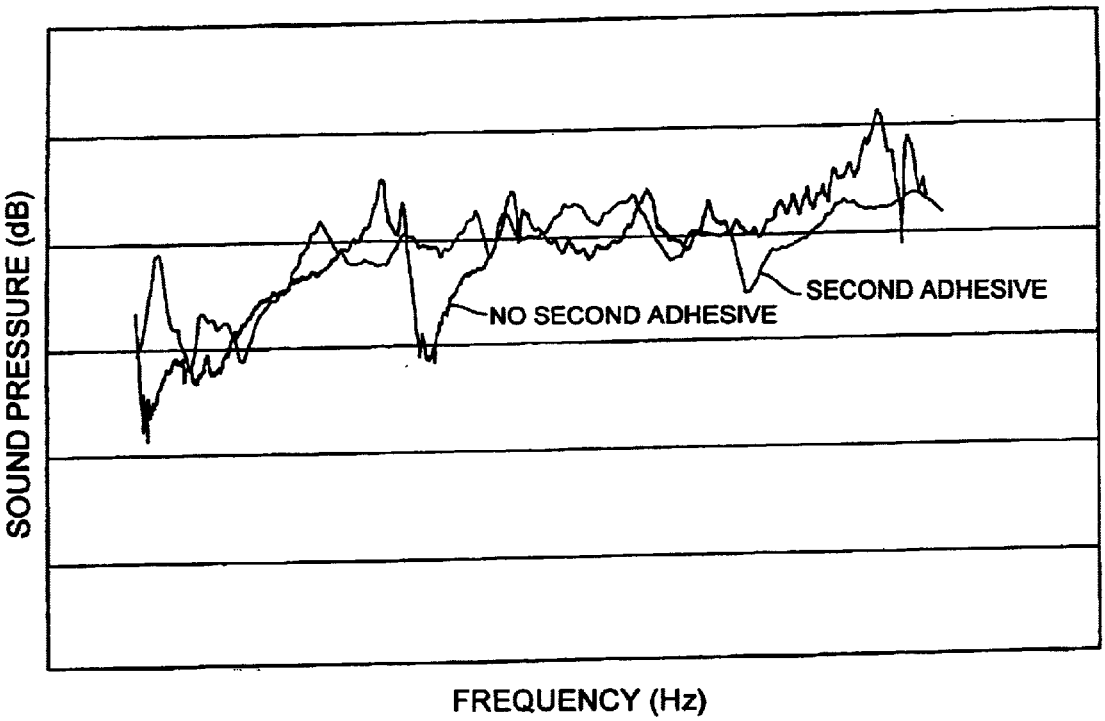
FIG. 6 is a characteristic graph showing the sound pressure levels obtained when the second adhesive was used or not.

The sound pressure characteristics obtained when the second adhesive was applied and not applied were measured. The results are shown in FIG. 6. As seen in FIG. 6, when no second adhesive is applied, peaks and dips in the sound pressure characteristic are relatively large. When the second adhesive is applied, substantially uniform sound pressure characteristics are produced.

Figure 7:
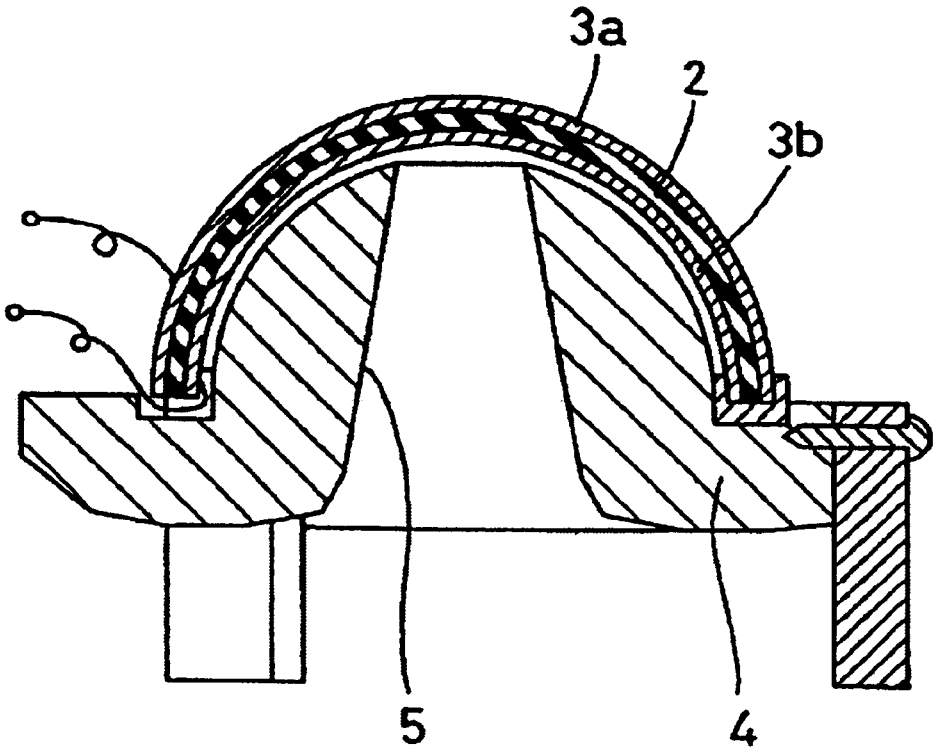
FIG. 7 PRIOR ART
FIG. 7 is a cross-section showing an example of a conventional speaker.

According to the speaker 10 of preferred embodiments of the present invention, as described above, by using the first adhesive 30 having a sufficient bonding strength, and the second adhesive having vibration-damping effects, a speaker having excellent sound pressure characteristics and high reliability can be provided. Also, when a base having a horn portion as shown in FIG. 7 is used as the base, in addition to the case of the flat plate base, a speaker having excellent sound pressure characteristics and high reliability is produced.

According to a preferred embodiment of the present invention, a speaker having a sound pressure characteristic with reduced peaks and dips is obtained. Further, the peeling away of the substantially hemispherical surface vibrator from the base, and the failure of the vibrator, caused by a thermal shock, is prevented. Therefore, a speaker having a high reliability is obtained.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A speaker comprising:

a substantially hemispherical surface vibrator having an inner electrode and an outer electrode;

a base bonded to an edge portion of the vibrator and having a bottom surface;

at least one terminal that is connected to one of the inner electrode and the outer electrode and extends substantially perpendicular to the bottom surface of the base;

a first adhesive disposed between the edge portion of the vibrator and the base to bond the vibrator to the base; and a second adhesive disposed at the circumference of the edge portion of the vibrator bonded to the base by the first adhesive; wherein said base includes at least one terminal groove for receiving said at least one terminal therein.

2. A speaker according to claim 1, wherein the substantially hemispherical surface vibrator includes a piezoelectric material.

3. A speaker according to claim 1, wherein the first adhesive has a bonding strength sufficient to fix the vibrator to the base.

4. A speaker according to claim 1, wherein the second adhesive has a bonding strength to secure the vibrator to the base and to damp the vibration of the vibrator.

5. A speaker according to claim 1, wherein the second adhesive has a lower elastic modulus than the first adhesive.

6. A speaker according to claim 1, wherein said first adhesive has an elastic modulus of approximately 150 Mpa.

7. A speaker according to claim 1, wherein said base includes a hole in approximately the center portion thereof.

8. A speaker according to claim 1, wherein said first adhesive is different from said second adhesive.

9. A speaker according to claim 1, wherein said first adhesive has a different modulus of elasticity compared to said second adhesive.

10. A speaker according to claim 1, wherein at least one of said first adhesive and said second adhesive is arranged to achieve vibration-damping effects to damp vibration between the vibrator and the base.

11. A speaker according to claim 1, further comprising at least two terminals and at least two terminal grooves, wherein each of said at least two terminals is connected to a respective one of the inner electrode and the outer electrode and passes through a respective one of the at least two terminal grooves.

12. A speaker comprising:

a substantially hemispherical surface vibrator having an inner electrode and an outer electrode;

a base bonded to an edge portion of the vibrator and having a bottom surface;

at least one terminal that is connected to one of the inner electrode and the outer electrode and extends substantially perpendicular to the bottom surface of the base;

a first adhesive and a second adhesive arranged to bond the vibrator to the base; wherein said first and second adhesives are different from each other; wherein said base includes at least one terminal groove for receiving said at least one terminal therein.

13. A speaker according to claim 12, wherein said first adhesive is disposed between the edge portion of the vibrator and the base.

14. A speaker according to claim 12, wherein said second adhesive disposed at the circumference of the edge portion of the vibrator bonded to the base by the first adhesive.

15. A speaker according to claim 12, wherein the substantially hemispherical surface vibrator includes a piezoelectric material.

16. A speaker according to claim 12, wherein the first adhesive has a bonding strength sufficient to fix the vibrator to the base.

17. A speaker according to claim 12, wherein the second adhesive has a bonding strength to secure the vibrator to the base and to damp the vibration of the vibrator.

18. A speaker according to claim 12, wherein the second adhesive has a lower elastic modulus than the first adhesive.

19. A speaker according to claim 12, wherein said first adhesive has an elastic modulus of approximately 150 Mpa.

20. A speaker according to claim 12, further comprising at least two terminals and at least two terminal grooves, wherein each of said at least two terminals is connected to a respective one of the inner electrode and the outer electrode and passes through a respective one of the at least two terminal grooves.

* * * * *